US009918599B1

(12) United States Patent
Bensimon

(10) Patent No.: US 9,918,599 B1
(45) Date of Patent: Mar. 20, 2018

(54) TOILET SEAT WITH SPLASH GUARD

(71) Applicant: Moshe Bensimon, Montreal (CA)

(72) Inventor: Moshe Bensimon, Montreal (CA)

( * ) Notice: Subject to any disclaimer, the term of this patent is extended or adjusted under 35 U.S.C. 154(b) by 0 days.

(21) Appl. No.: 15/254,275

(22) Filed: Sep. 1, 2016

Related U.S. Application Data

(60) Provisional application No. 62/212,881, filed on Sep. 1, 2015.

(51) Int. Cl.
*A47K 13/14* (2006.01)
*E03D 9/00* (2006.01)

(52) U.S. Cl.
CPC ..... *A47K 13/14* (2013.01); *E03D 9/00* (2013.01)

(58) Field of Classification Search
CPC ..... A47K 13/14; A47K 13/08
USPC ..... 4/234, 300.3
See application file for complete search history.

(56) References Cited

U.S. PATENT DOCUMENTS 4,928,328 A * 5/1990 Davis ..... E03D 11/02 4/237
5,216,760 A 6/1993 Brown et al.
5,373,589 A * 12/1994 Rego ..... E03D 9/00 4/300.3
5,625,905 A 5/1997 Woods
5,887,291 A 3/1999 Bellizzi
6,119,282 A 9/2000 Serbin
8,266,731 B2 9/2012 Marra
2006/0096015 A1* 5/2006 Lim ..... A47K 13/24 4/300.3

FOREIGN PATENT DOCUMENTS

EP 1552778 A2 7/2005

OTHER PUBLICATIONS

5 Child-Friendly Home Improvements, Double toilet seat cover from Hoe Kee. Blog Article [online]. Ira Sophia, 2013. [Retrieved on May 29, 2015]. Retrieved from the Internet: http://www.mom-myfordummy.com/content/5-child-friendly-home-improvements.

* cited by examiner

*Primary Examiner* — Janie Loeppke
(74) *Attorney, Agent, or Firm* — Robert C. Montgomery; Montgomery Patent & Design

(57) ABSTRACT

A toilet seat includes a lid, a splash guard, and a seat. The splash guard is affixed to a perimeter edge of the seat in a sealed manner. The splash guard is composed of flexible members including a plurality of flat sections being connected by fan-fold pleat sections. The splash guard lays flat for normal seated use, or may be deployed upward to form a vertical barrier to contain and direct any liquids into the toilet bowl. In a preferred embodiment, the splash guard and seat are horseshoe-shaped.

10 Claims, 5 Drawing Sheets

TOILET SEAT WITH SPLASH GUARD

RELATED APPLICATIONS

The present invention was first described in and claims the benefit of U.S. Provisional Application No. 62/212,881 filed Sep. 1, 2015, the entire disclosures of which are incorporated herein by reference.

FIELD OF THE INVENTION

The present invention relates generally to the field of a sanitary bathroom device including a lid, a splash guard, and a seat.

BACKGROUND OF THE INVENTION

The battle to keep private and public restrooms clean and fresh smelling is everlasting. This is especially true in men's bathrooms and restrooms where, during the male's urination process in a standing position, urine may splash out of the toilet area or even miss the bowl entirely. When this occurs, a large amount of urine ends up on the toilet seat, lid, tank, bowl exterior, and even the floor and surrounding areas. In just a few seconds, the entire toilet and immediate area can be turned into a smelly mess that takes a large amount of time to clean up. Even worse, should it not be cleaned up, and a following user need to use the toilet quickly in a seated manner, he or she finds themselves sitting in urine. Accordingly, there exists a need for a means by which the urination stream from a male in a standing position can be redirected such that it ends up on the toilet bowl at all times. The use of the toilet seat with a splash guard ensures that urine from male urination is contained within the toilet bowl in a manner which is not only quick, easy, and effective, but clean and sanitary as well.

SUMMARY OF THE INVENTION

The inventor has recognized the aforementioned inherent problems and lack in the art and observed that there is a need for a sanitary bathroom device including a lid, a splash guard, and a seat.

It is therefore an object of the invention to provide a splash guard, comprising a seat which has an open end, a mounting assembly which extends rewardly from a rear of the seat and opposite the open end of the seat and is capable of mounting the seat to a toilet bowl rim and a splash guard assembly. The splash guard assembly is attached superjacent to the seat by an outer weld which is located at common outer perimeter edge. Additionally, the outer weld enables the splash guard assembly to flexibly extend outwardly and above the periphery of the seat. In an alternate embodiment there is a hinge assembly, in lieu of the mounting assembly, which extends rewardly from the rear of the seat and opposite the open end of the seat and is capable of mounting the seat to the toilet bowl rim. In this alternate embodiment a lid is attached to the seat by means of the hinge assembly.

The splash guard assembly may comprise a plurality of flat sections and may each be coplanar with each other. The plurality of flat sections may further comprise a generally arcuate shape which has a sloping configuration from the outer perimeter edge to an inner perimeter edge. The plurality of flat sections may further comprise a flexible construction.

Each individual flat section may be coextensive with an adjacent individual flat section via a joint weld which is secured within a recess of each of the individual flat section. Each joint comprises a pleated section and comprises a first side, a second side, a third side, a first fold line which is disposed between the first side and the second side and a second fold line which is disposed between the second side and the third side. In a closed state the first side and the third side reside subjacent the recess and the second side resides subjacent the first side and the third side. In an open state, the first side is angled away from the second side while the third side is angled away from the second side in a mirror image to the first side.

Each joint may be secured in an open state when the second side is placed in a position superjacent to each respective recess and may be released in a collapsed state when the second side is placed in a position which is subjacent to each respective recess. The seat may also comprise injection molded plastic.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
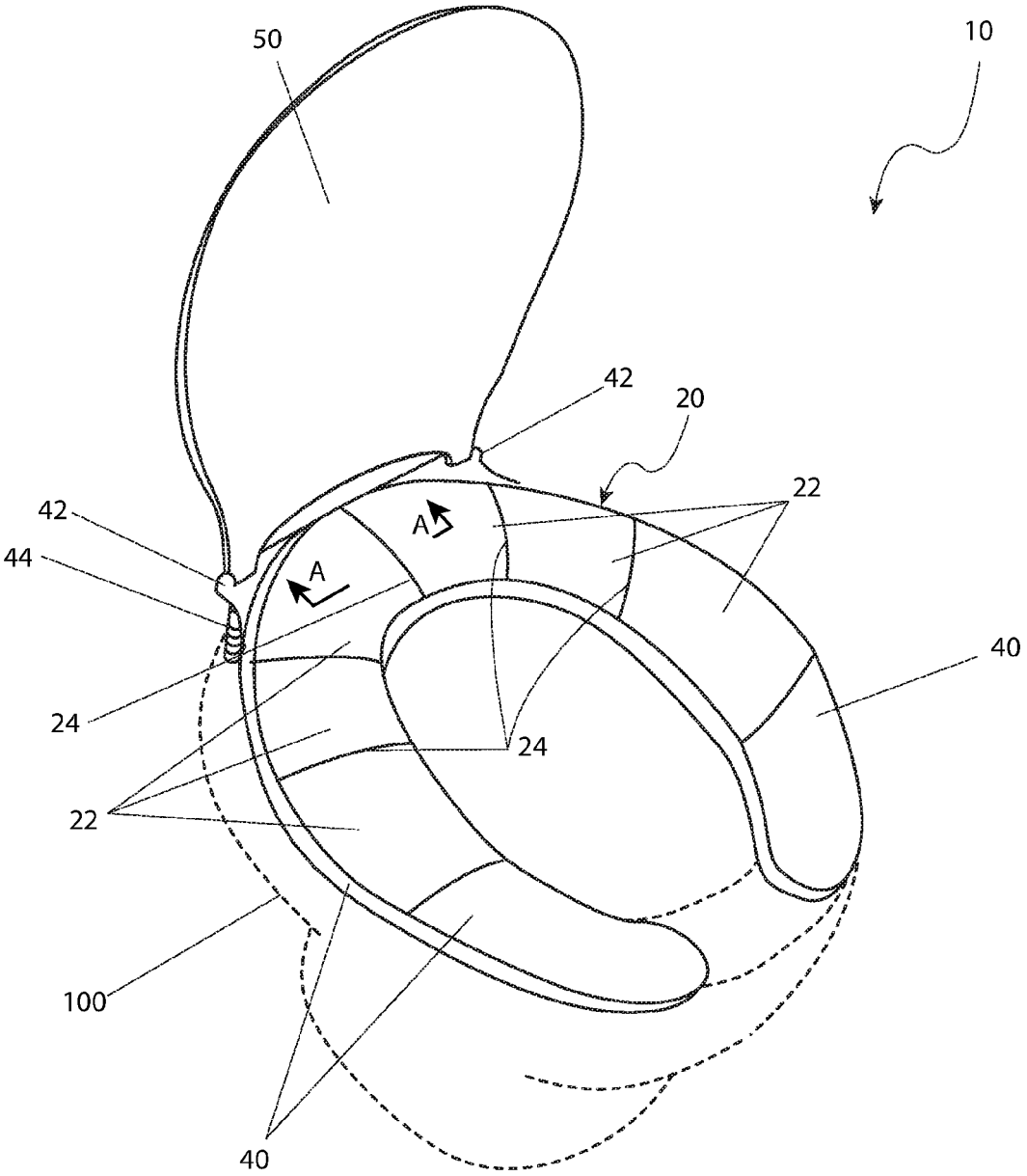
FIG. 1 is a perspective front side view of an improved toilet seat with splash guard 10 depicting a collapsed state, according to a preferred embodiment of the present invention.

10 toilet seat
15 alternate toilet seat
20 splash guard assembly
22 flat section
23 recess
24 joint
25 first pleat section
26 second pleat section
27 third pleat section
28*a* first fold line

28*b* second fold line
29 outer weld
30 joint weld
40 seat
42 hinge assembly
44 mounting stud
50 lid
100 toilet bowl

DETAILED DESCRIPTION OF THE PREFERRED EMBODIMENT

The best mode for carrying out the invention is presented in terms of its preferred embodiment, herein depicted within FIGS. 1 through 5. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one (1) particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes an improved toilet seat with a splash guard (herein described as the "apparatus") 10, which provides a means for liquid waste control built into a toilet seat, capable of containing and directing errantly deposited urine into a subjacent toilet bowl 100. The apparatus 10 and 15 is envisioned to be utilized primarily during standing urination, and may be especially beneficial during a period of toilet training as well.

Figure 4:
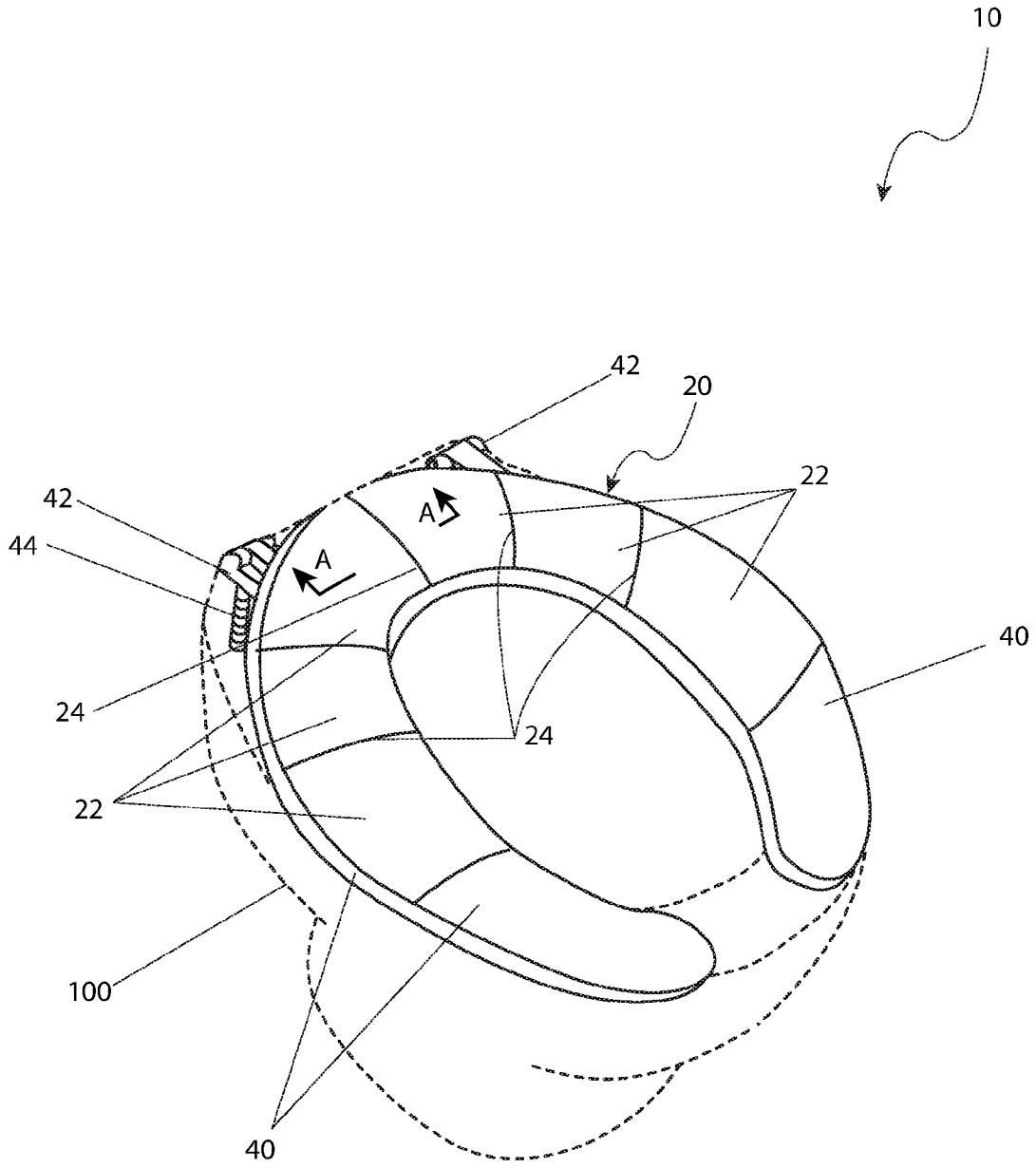
FIG. 4 is a perspective front side view of an improved toilet seat with splash guard 10 depicting a collapsed state without a lid 50, according to an alternate embodiment of the present invention; and, FIG. 5 is a perspective rear side view of an improved toilet seat with splash guard 10 depicting a collapsed state without a lid 50, according to an alternate embodiment of the present invention.
Figure 5:
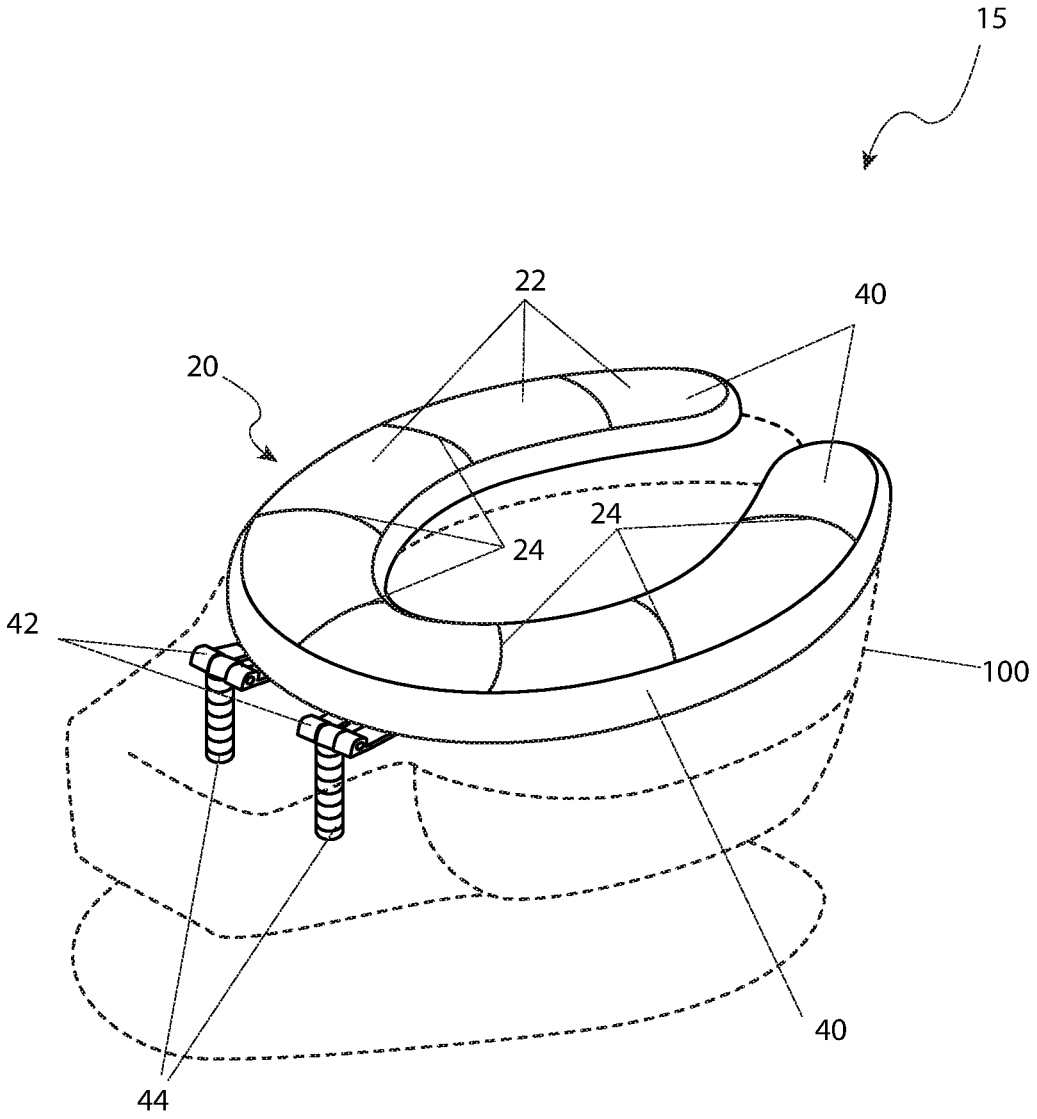

Referring now to FIG. 1, a perspective view of the apparatus 10 depicting a collapsed state, according to the preferred embodiment of the present invention, is disclosed. The apparatus 10 includes a splash guard assembly 20, a lower seat 40, a hinge assembly 42, and a lid 50. When configured in a collapsed state, during times when the splash guard assembly 20 is not needed, the apparatus 10 appears and functions like that of a conventional toilet seat unit. Referring now to FIG. 4, the apparatus 15, in alternate embodiment, includes a splash guard assembly 20, a lower seat 40 and a hinge assembly 42, absent a lid 50. The hinge assembly 42, of FIGS. 1 and 4, is detailed more fully in FIG. 5.

It is envisioned that the apparatus 10 would be made available in different popular designs which are compatible with new and existing toilet bowl 100 designs as well being available in various matching colors. The seat portion 40 of the apparatus 10 is envisioned being made of hard plastic and manufactured in an injection molding process. The seat 40 includes an integral hinge assembly 42 which extends from a rear edge and incorporates integrally-molded features to enable attachment and rotation of the seat 40 and the lid 50 along a single axis in a conventional manner. The hinge assembly 42 also provides integral mounting studs 44 for standard mounting of the apparatus 10 to new and existing toilet bowls 100.

The apparatus 10 comprises a plurality of flat sections 22 being arc-shaped, coplanar with each other, and are similarly sized. The flat sections 22 are envisioned being made in an injection-molding or extruding process using a flexible polymer material such as soft plastic, rubber, polyurethane, or the like, being capable of slight deformation during deployment of the splash guard assembly 20 (see FIG. 2). The apparatus 10 is illustrated here having an overall horseshoe-shape which corresponds to a similarly shaped subjacent toilet bowl 100; however, it is understood that the apparatus 10 would be available in different designs to fit properly upon various toilet bowl 100 designs, and as such should not be interpreted as a limiting factor of the invention 10.

The outer perimeter edge of the flat sections 22 form a continuous waterproof attachment to the subjacent seat 40 via an outer weld 29. The outer weld 29 is preferably formed using a plastic welding process, or an equivalent water-proof attachment method. The attachment of the flat sections 22 to the seat 40 would be designed with an appropriate profile so as to contain and redirect any liquids received during use, into the toilet bowl 100 (see FIG. 2). The flat sections 22 are to lay securely upon the seat 40, and to collectively emulate an outline portion of the subjacent seat 40. The flat sections 22 extend around a major portion of the seat 40 and are slightly sloped downward toward a center portion of the existing toilet bowl 100. The flat sections 22 are joined by a joint 24 having a first pleat section 25, a second pleat section 26 and a third pleat section 27 affixed thereto. In use, each joint 24 opens to allow deployment of the included and subjacent pleat sections 25, 26 and 27 which acts to form a continuous splash guard assembly 20 (see FIG. 2).

Figure 2:
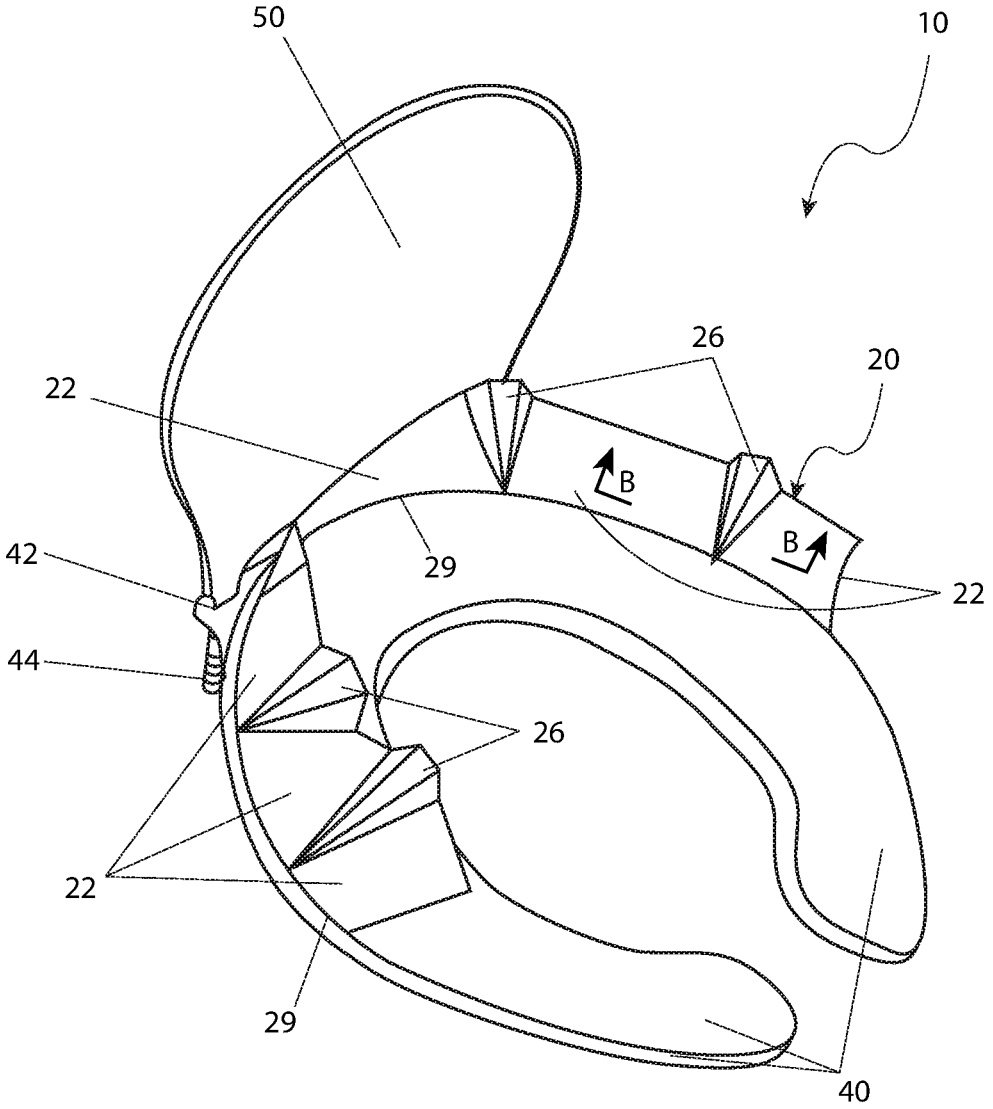
FIG. 2 is another perspective front side view of the toilet seat 10 depicting a deployed splash guard assembly 20, according to a preferred embodiment of the present invention.

Referring now to FIG. 2, a perspective view of the apparatus 10 depicting a deployed splash guard assembly 20, according to a preferred embodiment of the present invention, is disclosed. The apparatus 10 comprises a plurality of pleat sections 25, 26 and 27 each being affixed to adjacent edge portions between each pair of flat sections 22. Each pleat section 25, 26 and 27 provides a triangle-shaped tri-fold structure made using semi-rigid plastic sheet material. Each pleat section 25, 26 and 27 is affixed along outer edge portions to corresponding edge portions of flat sections 22 preferably using a joint weld 30 formed using a plastic welding process or equivalent polymer joining method. The pleat sections 25, 26 and 27 are to be laterally expandable in a fan-fold manner via a first fold line 28*a* and a second fold line 28*b* which enable the pleat sections 25, 26 and 27 to fold to a flat state and be stored under the recess sections 23, as well as allowing the pleat sections 25, 26 and 27 to be forced outwardly and "snapped" into an erect locked state, thus retaining the splash guard assembly 20 in a generally vertical position as seen here (also see FIGS. 3*b* and 3*c*).

Figure 3A:
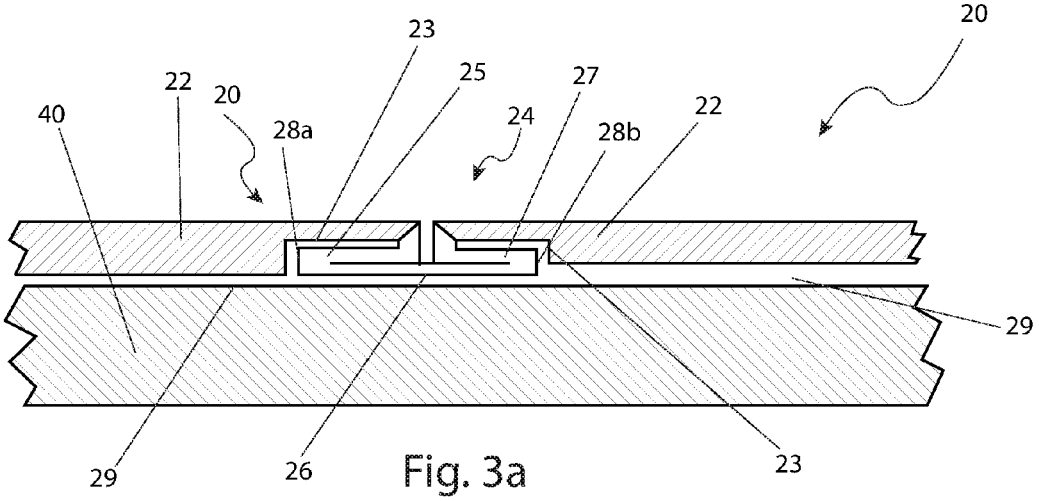
FIG. 3*a* is a sectional view of the toilet seat 10 depicting a collapsed state taken along section line A-A (see FIG. 1), according to a preferred embodiment of the present invention.
Figure 3B:
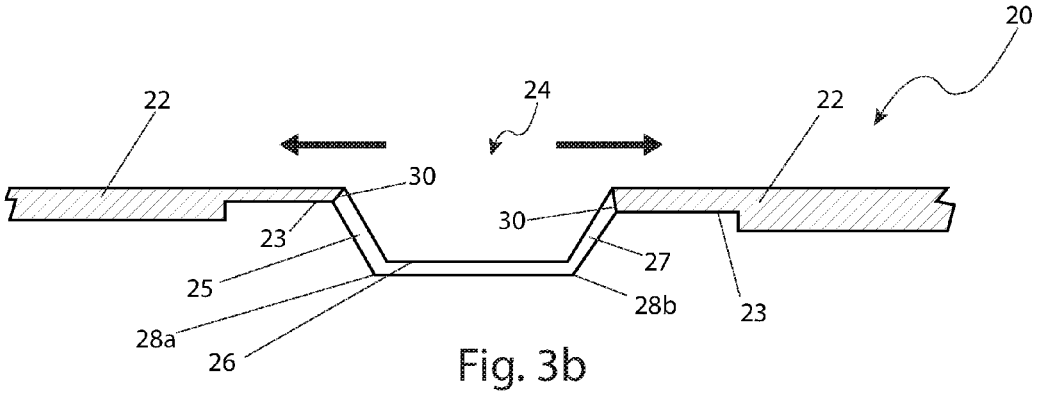
FIG. 3*b* is a sectional view of the toilet seat 10 depicting a partially deployed splash guard assembly 20 taken along section line B-B (see FIG. 2), according to a preferred embodiment of the present invention.
Figure 3C:
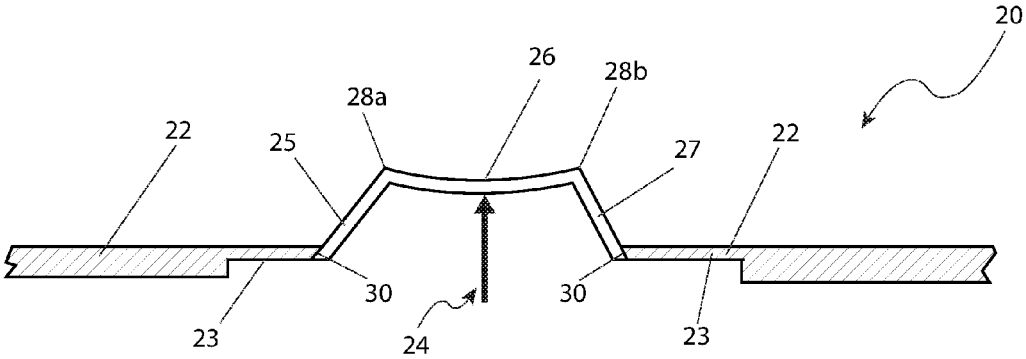
FIG. 3*c* is another sectional view of the toilet seat 10 depicting a deployed and locked state of the splash guard assembly 20 also taken along section line B-B (see FIG. 2), according to a preferred embodiment of the present invention.

Referring now to FIGS. 3*a*, 3*b*, and 3*c*, sectional views of the apparatus 10 depicting different states of the pleat sections 25, 26 and 27 according to a preferred embodiment of the present invention, are disclosed. In their collapsed position, each pleat section 25, 26 and 27 folds into a flat state being stored within recess portions 23 of each flat section 22, being located along each bottom side edge. This state of the pleat sections 25, 26 and 27 allows the flat sections 22 to lie in a coplanar manner upon the seat portion 40 allowing the apparatus 10 to be utilized for normal toiled duties when in an un-deployed state.

To deploy the splash guard assembly 20, the inward edges of the flat sections 22 are lifted upward about the outer weld 29, while coincidentally expanding the affixed pleat sections 25, 26 and 27 until the splash guard assembly 20 obtains an upright position. The pleat sections 25, 26 and 27 are then manually deformed in an outward direction causing them to "snap" to an inside-out configuration, thereby securing the splash guard assembly 20 in a vertical position.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing and utilizing the apparatus 10 may be achieved by performing the following steps: procuring a model of the apparatus 10 having a desired design and color; mounting the apparatus 10 to a new or existing toilet bowl 100 using the mounting stud portions 44 in a conventional manner; utilizing the apparatus 10 for normal seated use in a similar manner as a conventional toilet seat, while allowing the pleat sections 25, 26 and 27 to remain folded and stored within the recesses 23 of the seat 40; utilizing and deploying the splash guard assembly 20 for standing urination purposes by lifting upward upon the inward edges of the flat sections 22; allowing the affixed pleat sections 25, 26 and 27 to coincidentally expand in a fan-fold manner until the flat sections 22 and pleat sections 25, 26 and 27 of the splash guard assembly 20 are in an upright position; securing the splash guard assembly 20 in its vertical position by continuing to deform the pleat sections 25, 26 and 27 in an outward direction causing them to "snap" and maintain an inside-out configuration; utilizing the apparatus 10 to perform standing urination duties; cleaning the apparatus 10 with appropriate cleaning supplies following urination; pressing inwardly upon the pleat sections 25, 26 and 27; allowing the pleat sections 25, 26 and 27 to fold to their flat state as the flat sections 22 descend down upon the seat 40; closing the lid in a normal manner until the toilet 100 and apparatus 10 are needed again; and, benefiting from improved liquid waste control during urination, afforded a user of the present invention 10.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A splash guard, comprising:

a seat having an open end;

a mounting assembly extending rearwardly from a rear of said seat, opposite said open end and capable of mounting said seat to a toilet bowl rim; and, a splash guard assembly, comprising a plurality of flat sections, each flexible and coplanar with each other, and comprising a generally arcuate shape having a sloping configuration from an outer perimeter edge to an inner perimeter edge;

wherein said splash guard assembly is attached superjacent to said seat by an outer weld located at common outer perimeter edges;

wherein each individual flat section is coextensive with an adjacent individual flat section via a joint weld secured within a recess of each said individual flat section; and, wherein said outer weld enables said splash guard assembly to flexibly extend outwardly and above the periphery of said seat.

2. The guard of claim 1, wherein each said joint comprises a pleated section comprising:

a first side;

a second side;

a third side;

a first fold line disposed between said first side and said second side; and, a second fold line disposed between said second side and said third side;

wherein when in a closed state said first side and said third side reside subjacent said recess;

wherein when in a closed state said second side resides subjacent said first side and said third side;

wherein when in an open state said first side is angled away from said second side; and, wherein when in an open state said third side is angled away from said second side in a mirror image to said first side.

3. The guard of claim 2, wherein each said joint may be secured in an open state when said second side is placed in a position superjacent to each respective recess.

4. The guard of claim 3, wherein each said joint may be released in a collapsed state when said second side is placed in a position which is subjacent to each respective recess.

5. The guard of claim 1, wherein said seat comprises injection molded plastic.

6. A splash guard, comprising:

a seat having an open end;

a hinge assembly extending rearwardly from a rear of said seat, opposite said open end and capable of mounting said seat to a toilet bowl rim;

a splash guard assembly, comprising a plurality of flat sections, each flexible and coplanar with each other, and comprising a generally arcuate shape having a sloping configuration from an outer perimeter edge to an inner perimeter edge; and, a lid attached to said seat via said hinge assembly;

wherein said splash guard assembly is attached superjacent to said seat by an outer weld located at common outer perimeter edges;

wherein each individual flat section is coextensive with an adjacent individual flat section via a joint weld secured within a recess of each said individual flat section; and, wherein said outer weld enables said splash guard assembly to flexibly extend outwardly and above the periphery of said seat.

7. The guard of claim 6, wherein each said joint comprises a pleated section comprising:

a first side;

a second side;

a third side;

a first fold line disposed between said first side and said second side; and, a second fold line disposed between said second side and said third side;

wherein when in a closed state said first side and said third side reside subjacent said recess;

wherein when in a closed state said second side resides subjacent said first side and said third side;

wherein when in an open state said first side is angled away from said second side; and, wherein when in an open state said third side is angled away from said second side in a mirror image to said first side.

8. The guard of claim 7, wherein each said joint may be secured in an open state when said second side is placed in a position superjacent to each respective recess.

9. The guard of claim 8, wherein each said joint may be released in a collapsed state when said second side is placed in a position which is subjacent to each respective recess.

10. The guard of claim 6, wherein said seat comprises injection molded plastic.

* * * * *